US005386673A

United States Patent [19]

Bellegarde

[11] Patent Number: 5,386,673

[45] Date of Patent: Feb. 7, 1995

[54] SUPPORTED RETURNED STAIR TREAD WITH MOISTURE-COMPENSATING JOINT AND METHOD FOR MAKING SAME

[75] Inventor: René P. Bellegarde, Lambton, Canada

[73] Assignee: Lambton Manufacturing Ltd., Quebec, Canada

[21] Appl. No.: 692,604

[22] Filed: Apr. 29, 1991

[51] Int. Cl.[6] ..... E04F 11/00

[52] U.S. Cl. ..... 52/182; 52/179; 52/716.1; 52/829; 52/784

[58] Field of Search ..... 52/179, 182, 183, 184, 52/188, 191, 716, 717.1, 718.1, 784, 783, 829, 830

[56] References Cited

U.S. PATENT DOCUMENTS

| | | | |
|---|---|---|---|
| 1,787,876 | 1/1931 | Sandman | 52/784 |
| 1,911,779 | 5/1933 | Uhl | 52/784 |
| 2,251,395 | 8/1941 | Campbell | 52/783 |
| 3,421,274 | 1/1969 | Balzer et al. | 52/179 |
| 3,590,754 | 7/1971 | Jakobsen | 52/784 X |
| 3,759,000 | 9/1973 | Balzer et al. | 52/179 |
| 3,901,353 | 8/1975 | Skolnik | 182/78 |
| 4,730,425 | 3/1988 | YHoung | 52/182 |
| 4,867,598 | 9/1989 | Winter | 403/381 |

*Primary Examiner*—Carl D. Friedman
*Assistant Examiner*—Kien Nguyen

[57] ABSTRACT

A returned stair tread for use on an open stairway or an open portion of a stairway is shown. This returned stair tread comprises a stair tread constructed of wood and a return nosing fitting flush against its side edge, the stair tread and nosing being slidably connected to one another by tongue and groove construction. The returned stair tread also comprises means for securing the nosing to the stair tread, including rigid securing means joining the nosing to the stair tread only in the region containing an exposed joint located at a forward end portion of the tread forward of the slidably connected construction. The returned stair tread further comprises a non-rigid securing means joining the nosing to the stair tread along the length of their mutual juncture, which non-rigid securing means is adapted to secure the continued contact of the nosing and stair tread while permitting each to expand and contract in width over a range due to changing ambient temperature and humidity conditions.

36 Claims, 2 Drawing Sheets

SUPPORTED RETURNED STAIR TREAD WITH MOISTURE-COMPENSATING JOINT AND METHOD FOR MAKING SAME

BACKGROUND OF THE INVENTION

The present invention relates generally to returned stair treads, and specifically to returned stair treads containing exposed joints on forward side edge portions thereof that will not pull apart, gap or otherwise become deformed due to changes in ambient temperature and humidity.

Returned stair treads, generally speaking, have long been known and used in the prior art. Typically such prior art stair treads include a tread constructed of wood with a return nosing affixed to a side edge of the former so as to form an exposed joint along a forward edge portion of the assembly. The nosing is usually glued to the side edge of the tread along the entire width of the latter and, in addition, is nailed thereto at several different positions.

A major problem that has been encountered with such construction is that the exposed joint will tend to gap open or otherwise become deformed when the returned stair tread is exposed to ambient temperature and humidity conditions beyond those encountered when the nosing was originally affixed to the stair tread. Such conditions are usually at their worst during late Summer when returned treads are stored or otherwise disposed in non-airconditioned circumstances such as in a warehouse or building under construction.

This problem was addressed in U.S. Pat. No. 4,730,425. The solution proposed by this reference to the problem of such temperature and humidity damage was to isolate the exposed joint of the nosing and stair tread by securing only the forwardmost three inches of the nosing. This is done in the reference by applying glue to only the first three inches of the nosing rearward of the exposed joint, or by providing a single nail also within the forwardmost three inches of the joint, or by a combination of the two. While this construction claims to have overcome the problem of damage caused by temperature and humidity, it does not appear to be without additional problems.

Most notably, in isolating the forward end of the nosing, the reference has allowed the remaining several inches of the length of the nosing to be unsupported with, typically, an overhang beyond the stair tread of an inch or more. During installation, this overhang may be caught on some obstruction and, because of its long lever arm, the nosing may be damaged or deformed. Further the presence of a nail, when employed as suggested in the reference, detracts from the appearance of the finished product in use. The placement of the nail can also cause damage to a drill bit or other construction equipment during installation, as when an installer cuts holes in the stair tread to install a banister.

Further, the groove cut in the return nosing typically runs an inch or more beyond the rearward edge of the stair tread in this prior art construction. When the nosing is trimmed, as is often done during installations, the groove may be exposed, leaving an unsightly appearance.

By means of the present invention, these difficulties encountered with the prior art returned stair treads have been substantially overcome.

SUMMARY OF THE INVENTION

It is an object of the present invention to provide a returned tread for use on an open stairway or on an open portion of a stairway which contains an exposed joint on a forward edge portion that will not pull apart or otherwise become deformed as a result of changes in width of the tread over a range such as can be caused by changes in ambient temperature and humidity.

It is a further object of the present invention to provide a returned stair tread for use on an open stairway or an open portion of a stairway wherein the nosing is adequately supported to prevent damage in handling, installation and use.

It is a still further object of the present invention to provide a returned stair tread for use on an open stairway or an open portion of a stairway wherein the evidence of its construction, as typified by visible nails and the like, is minimized.

It is another object of the present invention to provide a method for making a returned stair tread for use on an open stairway or an open portion of a stairway, which returned stair tread has an exposed joint on a forward edge thereof which will not become gaped or deformed as a result of expansion or contraction of the width of the stair tread over a range due to changes in ambient temperature and humidity.

These and other objects, features, and advantages of the present invention will become apparent to those skilled in the art from the following detailed description and attached drawings, upon which only the preferred embodiments of my invention are illustrated.

According to one embodiment of the present invention, there is provided a returned stair tread for use on an open stairway or on an open portion of a stairway, said returned stair tread comprising:

- a stair tread constructed of wood and having at least one side edge fashioned to fit flush against an opposing surface of a return nosing to form an exposed joint between said stair tread and nosing along a forward end portion of said tread and nosing;
- a return nosing fitting flush against said side edge, said stair tread and nosing being slidably connected to one another by tongue and groove construction extending along at least a rear portion of said side edge rearward of said exposed joint; and,
- means for securing said nosing to said stair tread, wherein said means comprises:
  - a rigid securing means joining said nosing to said stair tread only in the region containing said exposed joint which is located on a forward end portion of said tread forward of said slidably connected construction, which rigid securing means is adapted to prevent gaping or other deformation of said exposed joint as said stair tread expands or contracts in width over a range due to changing ambient temperature and humidity conditions; and,
  - a non-rigid securing means joining said nosing to said stair tread along the length of their mutual juncture, which non-rigid securing means is adapted to secure the continued contact of said nosing and stair tread while permitting each to expand and contract in width over a range due to changing ambient temperature and humidity conditions.

According to another embodiment of the present invention there is provided a method for making a returned stair tread for use on an open stairway or an open portion of a stairway, the steps of which comprise:

providing a stair tread constructed of wood;

fashioning at least one side edge of said stair tread to fit flush against an opposing surface of a return nosing to from an exposed joint between said stair tread and nosing along a forward end portion of said tread and nosing;

providing a return nosing for fitting flush against said side edge, said stair tread and nosing being slidably connected to each other by tongue and groove construction along a rear portion of said side edge; and, securing said nosing to said tread by:

providing a rigid securing means only along a region containing said exposed joint which is located on a forward end portion of said tread forward of said slidably connected construction such that no significant gap or deformation will occur in said exposed joint as the result of expansion or contraction of said stair tread over a range of ambient temperature and humidity; and, providing a non-rigid securing means along the length of the mutual juncture, which non-rigid securing means is adapted to secure the continued contact of said nosing and stair tread while permitting each to expand and contract in width over a range due to changing ambient temperature and humidity conditions.

DETAILED DESCRIPTION OF THE PREFERRED EMBODIMENTS

Figure 1:
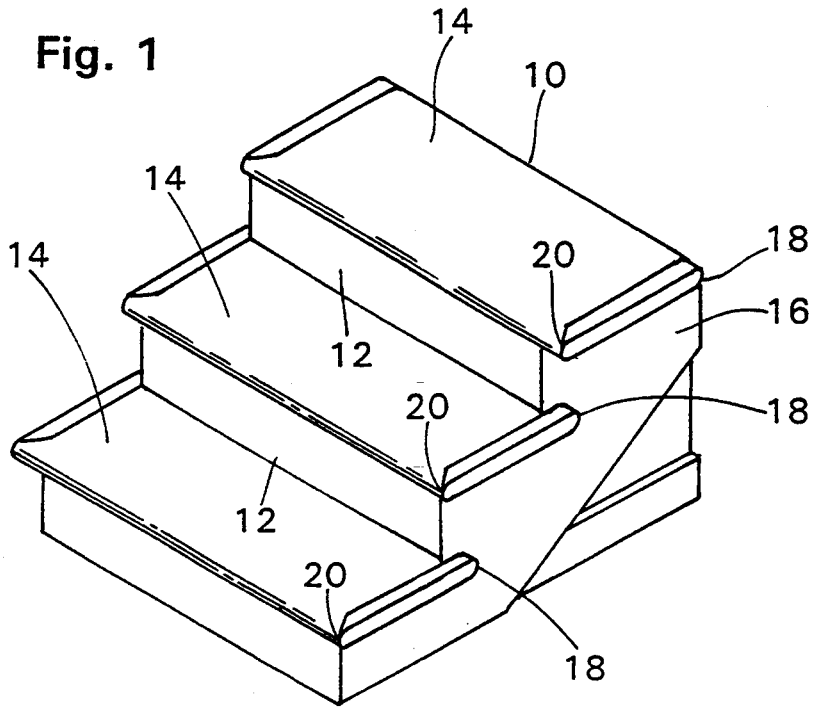
FIG. 1 shows a perspective view of a portion of an open stairway having return nosings connected to side edges of various stair treads, thus illustrating one of the preferred embodiments of the present invention.

Referring now to FIGS. 1–4 of the drawings, there is shown, in one preferred embodiment of the present invention, an open stairway 10 having risers 12 wooden treads 14 and a stringer 16 on the open side or sides thereof. The risers 12 and the treads 14 will usually be of selected height and width, respectively, to meet building code requirements. A front edge portion of each tread 14 rests upon and extends forwardly beyond a different one of the risers 12 in overlapping relationship therewith while side edge portions of each tread 14 rest upon a different horizontally extending upper edge of the stringers 16, only one of which is shown. A return nosing 18 is connected to each side edge portion of each of the treads 14 which lie in an open portion of the stairway 10. In the example of FIG. 1, the return nosings 18 and the corresponding treads 14 to which they are connected form a rounded or shaped, exposed joint 20 on the forward ends of the side edge portions thereof as viewed in plan. The rearward end portions of the nosings 18 extend behind corresponding risers 12 along and flush with the stringer 16 for short distances. FIG. 1 shows only the conventional portions of the treads 14 and nosings 18 of the present invention as they would appear on an open stairway in a fully assembled state.

Figure 2:
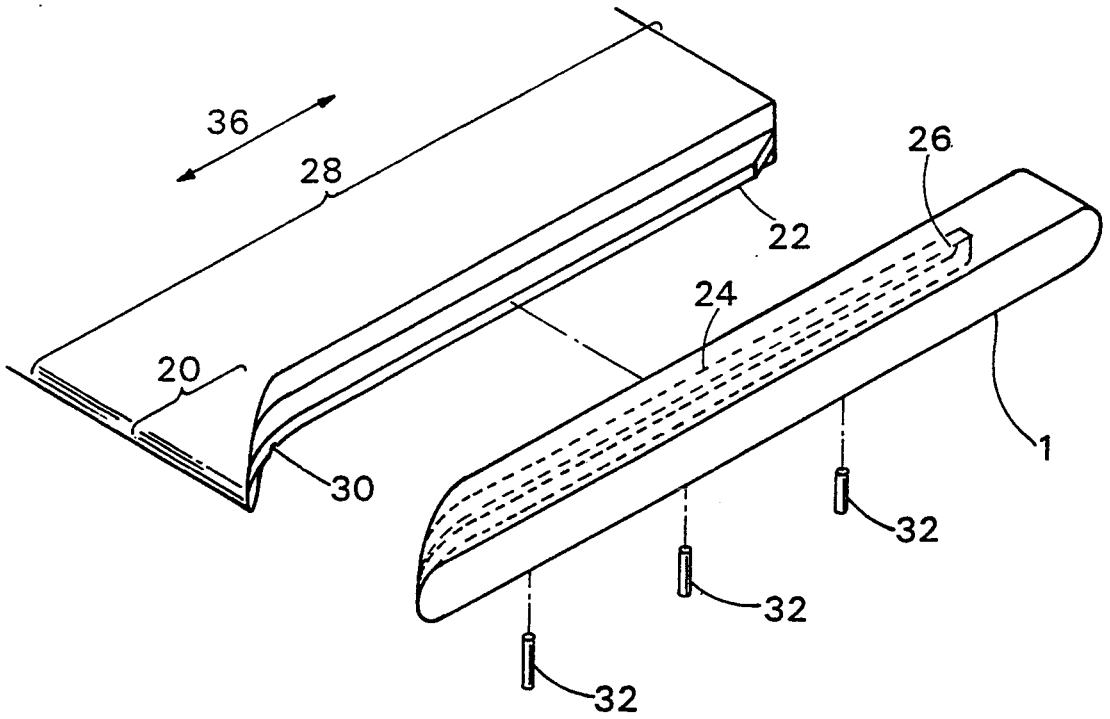
FIG. 2 shows a perspective view of a side portion of one of the stair treads of FIG. 1 with its corresponding return nosing and pins exploded therefrom.
Figure 3:
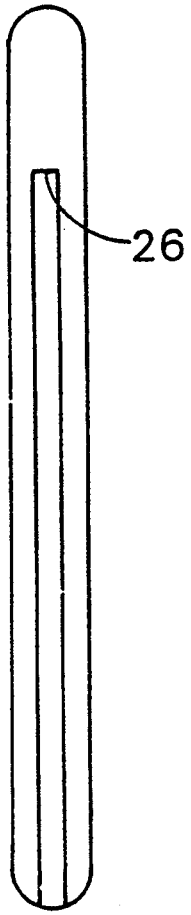
FIG. 3 shows an edge view of the return nosing of FIG. 2 rotated from its position as shown in the latter figure to illustrate a longitudinally extending groove therein.
Figure 4:
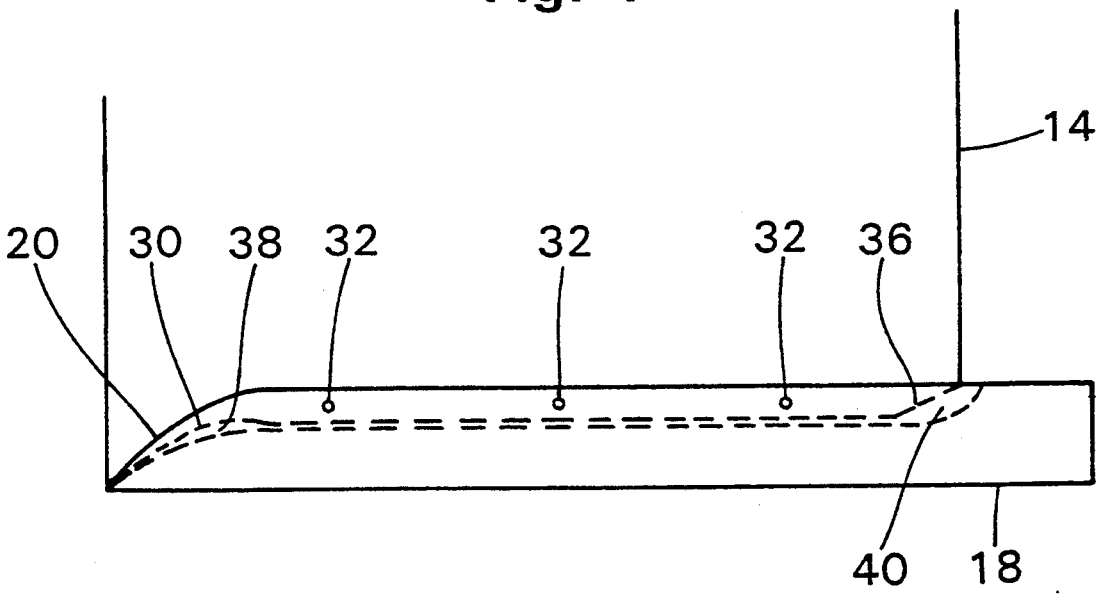
FIG. 4 shows the assembled returned stair tread of the present invention in plan.

Referring now particularly to FIGS. 2–4, the novel features of the tread 14 and return nosing 18 of the present invention will be seen. Those two elements feature a tongue and groove type construction. Specifically, a tongue 22 is formed along the entire side edge of the tread 14 including both the straight portion and the curved contour of the shaped portion where the shaped joint 20 occurs. An elongated groove 24, shown in shadow, conforming in size and shape to the tongue 22 for close-fitting, longitudinally slidable relationship therebetween is formed in the edge of the nosing 18 which opposes the edge of the tread 14.

In the practice of the present invention it has been found advantageous to provide a tongue and groove construction of greater dimension. Typical tongue and groove constructions of the prior art have employed a tongue extending from one-sixteenth of an inch (1/16″) to one-quarter of an inch (¼″), while the tongue of the present invention may be from about one-quarter of an inch (¼″) to about three-quarters of an inch (¾″), and a tongue of five-eighths of an inch (⅝″) has advantageously been employed. A larger tongue and deeper groove increases the glue surface substantially, and adds to the stability of the rigid securing means.

The groove 24 extends from the forward end of the nosing 18 to a position approximately equal to but just slightly longer than the rearward end of the tread 14 and tongue 22 as indicated at 26 short of the rearward end of the nosing 18. While the groove 24 could be formed all the way to the rearward end of the nosing 18 consistent with the present invention, stopping the groove 24 short of the rearward end of the nosing 24 as shown insures that the rearward end of the groove 24 will not be visible from behind the nosing 18 so as to cause an unsightly appearance even if the nosing is trimmed in place in the field.

The nosing 18 and tread 14 are attached to each other by a localized rigid securing means in the area of the exposed joint 20, and a non-localized, non-rigid securing means throughout the length of their juncture 28 (FIG. 2 only).

The localized rigid securing means may be effected as follows. A suitable wood glue or adhesive such as, for example, polyvinyl acetate is applied to the side edge of the tread 14 or the opposing surface of the nosing 18 along the shaped joint 20. The glued portion should be located in a region immediately rearward of the forward edge of the nosing and contiguous with the exposed joint 20 such that no significant gaping or deformation will occur in the exposed joint 20 even with substantial expansion and contraction of the width of the stair tread 14 over a range due to changes in ambient temperature and humidity. It has been found that the glued portion should not extend further than about three inches from the forward edge of tread 14.

In practice, this limitation is accomplished by providing a sculptured cut 30 at the forward end of the tongue 22. This sculptured cut 30 acts as a glue reservoir, shown as the void 38 in FIG. 4, and a bead of glue applied to the sculptured cut 30 will spread throughout the region of the exposed joint 20 when the stair tread and nosing are joined, as shown in FIG. 4.

The non-localized, non-rigid securing means may be effected as follows. A suitable non-hardening glue or adhesive is applied to the side edge of the tread 14 or the opposing surface of the nosing 18 along the length of their juncture 21. Alternatively, or in conjunction therewith, a plurality of pins 32 (FIG. 2 only) may be inserted through the tongue and groove assembly of the nosing 18 and the tread 14. Three such pins 32 are shown in FIG. 2 and have been employed advantageously for this purpose. As shown in the exploded drawing, these pins 32 may most advantageously be inserted from the underside of the returned stair tread construction to significantly reduce any affect on the appearance of the finished stair tread, and may be countersunk below the surface to further conceal their presence.

These pins 32 should be of a length to interconnect the tongue and groove construction both above and below the tongue. These pins 32 may be from about one-half inch (½") to about one inch (1") long and from approximately one thirty-second of an inch (1/32") to approximately three thirty-seconds of an inch (3/32") in gross diameter. Thus, the pins 32 may be from a length just slightly exceeding the thickness of the tongue up to the thickness of the returned stair tread. Further, the pins 32 may have any suitable cross-sectional geometry, such as circular or oval, or rectangular, which may even be bent to form a "V" in cross section. In practice, it has been shown to be advantageous to employ pins 32 which are one-sixteenth of an inch (1/16") in diameter and about seven-eighths of an inch (⅞") in length. Such pins are then advantageously countersunk about one-eighth of an inch (⅛") into the surface of the nosing 18.

Now by reason of the fact that the wood grain of the tread 14 extends generally across its width from the front to the back thereof, expansion and contraction of the tread 14 will occur in the directions indicated by the double-headed arrow 36 (FIG. 2 only). As the tread 14 expands and contracts, the tongue 22 is able to slide along the groove 24 at every position along their adjoining surfaces except at the position of the localized rigid securing means at the exposed joint 20. Since the localized rigid securing means is located quite close to the exposed joint 20, the latter lies within the region where little if any expansion or contraction will occur such that no unsightly gap or other deformation will occur in the joint 20 even where the tread 14 is exposed to relatively wide temperature and humidity variations. Thus, while the prior art taught that it was possible to use both glue in the joint 20 and a suitable mechanical fastener 28 to fasten the nosing 18 to the tread 14, the latter two elements can be adequately secured together by using glue in the joint 20, without using a mechanical fastener.

One of the unique features of the present invention is the second sculptured cut 36 at the rear of tongue 22. In addition to providing a means for suitable construction without undo gaping if the tongue and groove are out of tolerance, the sculptured cut 36 also acts in concert with the rearward end 26 of elongated groove 24 to form a small air reservoir or chase 40, shown in FIG. 4.

This air chase 40 provides exposure to ambient air and moisture, and provides an area for expansion of the stair tread 14. This air chase 40 is created because the elongated groove 24 has its rearward end 26 approximately equal to but just slightly beyond the rearward end of the tread 14, typically exceeding the tread length by only about one sixteenth of an inch (1/16"). This allows the rear of the nosing 18 to be trimmed in place in the field without exposing an open groove.

One skilled in the art will recognize that the tongue and groove construction shown in the preferred embodiment could easily be reversed, with a tongue formed on the nosing and a groove cut into the stair tread. Alternatively, grooves could be cut in both the nosing and the stair tread, and a key of suitable shape inserted between the two. The use of tongue and groove throughout this specification and in the claims that follow in intended to include such equivalent constructions.

One drawback of such alternative constructions, however, is the use of pins 32 within the stair tread 14. A drill bit striking a mechanical fastener, such as those employed in the prior art, can be damaged. The small size of the pins employed in the present invention should not interfere with the installation of banister rungs. Still, the pins should ideally be located where they are protected from banister locations.

Alternatively, such constructions would have application where banisters are not employed, or are attached directly to the stringer or a skirt board.

In practice, treads and nosings of the type previously described have performed adequately, and have overcome the problems of temperature and humidity while at the same time providing adequate structural integrity in handling, installation and use.

Although the present invention has been described with respect to specific details of certain preferred embodiments thereof, it is not intended that such details limit the scope and coverage of this patent otherwise than as set forth in the following claims, such claims being intended to cover not only the invention as shown and described herein, but also the reasonable equivalents thereof.

What is claimed is:

1. A returned stair tread for use on an open stairway or on an open portion of a stairway, said returned stair tread comprising:

a stair tread constructed of wood and having at least one side edge fashioned to fit flush against an opposing surface of a return nosing to form an exposed joint between said stair tread and nosing along a forward end portion of said tread and nosing;

a return nosing fitting flush against said side edge, said stair tread and nosing being slidably connected to one another by tongue and groove construction extending along at least a rear portion of said side edge rearward of said exposed joint; and, means for securing said nosing to said stair tread, wherein said means comprises:

a rigid securing means joining said nosing to said stair tread only in the region containing said exposed joint which is located on a forward end portion of said tread forward of said slidably connected construction, which rigid securing means is adapted to prevent gaping or other deformation of said exposed joint as said stair tread expands or contracts in width over a range due to changing ambient temperature and humidity conditions; and, a non-rigid securing means joining said nosing to said stair tread along the length of their mutual juncture, which non-rigid securing means is adapted to secure the continued contact of said nosing and stair tread while permitting each to expand and contract in width over a range due to changing ambient temperature and humidity conditions.

2. The returned stair tread of claim 1 wherein said exposed joint comprises a shaped joint.

3. The returned stair tread of claim 1 wherein said rigid securing means comprises an adhesive or glue applied between the adjoining surfaces of said exposed joint.

4. The returned stair tread of claim 3 wherein said adhesive or glue is applied rearwardly of said exposed joint but not more than about three inches from the front edge of said stair tread.

5. The returned stair tread of claim 1 wherein said non-rigid securing means comprises a plurality of pins inserted through the tongue and groove assembly of said nosing and stair tread.

6. The returned stair tread of claim 5 wherein the number of pins is two.

7. The returned stair tread of claim 5 wherein the number of pins is three.

8. The returned stair tread of claim 5 wherein the number of pins is four.

9. The returned stair tread of claim 5 wherein the pins are from approximately one-half of an inch (½") to approximately one inch (1") long and from approximately one thirty-second of an inch (1/32") to approximately three thirty-seconds of an inch (3/32") in diameter.

10. The returned stair tread of claim 9 wherein the pins are countersunk from approximately one sixteenth of an inch (1/16") to approximately one-half of an inch (½") below the surface of said returned stair tread assembly.

11. The returned stair tread of claim 1 wherein said exposed joint comprises a shaped joint, and wherein said tongue and groove construction includes:

a tongue extending along the entire side edge of said stair tread; and, a groove opposing said tongue and extending from the forward end of said nosing along said opposing surface to a position approximately equal to the rearward edge of said stair tread.

12. The returned stair tread of claim 1 wherein the tongue of said construction extends outward from the side edge of said stair tread approximately one-quarter of an inch (¼") to approximately three-quarters of an inch (¾"), and the groove of the nosing of said construction is dimensioned to accommodate a tongue of such dimension.

13. The returned stair tread of claim 1 wherein the tongue of said construction extends inward from the inside edge of said nosing approximately one-quarter of an inch (¼") to approximately three-quarters of an inch (¾"), and the groove of the stair tread of said construction is dimensioned to accommodate a tongue of such dimension.

14. The returned stair tread of claim 1 wherein the tongue of said returned stair tread is sculptured in the area of said rigid securing means to provide a reservoir for the application of a suitable amount of glue, which reservoir would provide glue to the surfaces of the tongue and groove construction substantially throughout the area of said rigid securing means when said stair tread and nosing are joined.

15. The returned stair tread of claim 1 wherein the tongue of said returned stair tread is sculptured at its rearward end to provide, in concert with said groove, an expansion reservoir therebetween.

16. A method for making a returned stair tread for use on an open stairway or an open portion of a stairway, the steps of which comprise:

providing a stair tread constructed of wood;

fashioning at least one side edge of said stair tread to fit flush against an opposing surface of a return nosing to from an exposed joint between said stair tread and nosing along a forward end portion of said tread and nosing;

providing a return nosing for fitting flush against said side edge, said stair tread and nosing being slidably connected to each other by tongue and groove construction along a rear portion of said side edge; and, securing said nosing to said tread by:

providing a rigid securing means only along a region containing said exposed joint which is located on a forward end portion of said tread forward of said slidably connected construction such that no significant gap or deformation will occur in said exposed joint as the result of expansion or contraction of said stair tread over a range of ambient temperature and humidity; and, providing a non-rigid securing means along the length of the mutual juncture, which non-rigid securing means is adapted to secure the continued contact of said nosing and stair tread while permitting each to expand and contract in width over a range due to changing ambient temperature and humidity conditions.

17. The method of claim 16 wherein the step of providing said rigid securing means comprises gluing said nosing to said stair tread along said exposed joint.

18. The method of claim 16 wherein the step of providing said non-rigid securing means comprises the insertion of a plurality of pins through said tongue and groove construction of said nosing and stair tread.

19. In a returned tread for use on an open portion of a stairway comprising a stair tread constructed of wood and having at least one side edge fashioned to fit flush against an opposing surface of a return nosing to form an exposed joint between said stair tread and nosing along a forward end portion of said tread and nosing, a return nosing fitting flush against said side edge, said stair tread and nosing being slidably connected to one another by tongue and groove construction extending along at least a rear portion of said side edge rearward of said exposed joint, and means for securing said nosing to said stair tread only in a region containing said exposed joint which is located on a forward end portion of said tread forward of said slidably connected construction to prevent gaping or other deformation of said exposed joint as said stair tread expands or contracts in width over a range due to changing ambient temperature and humidity conditions, wherein the improvement comprises a non-rigid securing means joining said nosing to said stair tread along the length of their mutual juncture, which non-rigid securing means is adapted to secure the continued contact of said nosing and stair tread while permitting each to expand and contract in width over a range due to changing ambient temperature and humidity conditions.

20. The returned stair tread of claim 19 wherein said exposed joint comprises a shaped joint.

21. The returned stair tread of claim 19 wherein said securing means comprises an adhesive or glue applied between the adjoining surfaces of said exposed joint.

22. The returned stair tread of claim 21 wherein said adhesive or glue is applied rearwardly of said exposed joint but not more than about three inches from the front edge of said stair tread.

23. The returned stair tread of claim 19 wherein said non-rigid securing means comprises a plurality of pins inserted through the tongue and groove assembly of said nosing and stair tread.

24. The returned stair tread of claim 23 wherein the number of pins is two.

25. The returned stair tread of claim 23 wherein the number of pins is three.

26. The returned stair tread of claim 23 wherein the number of pins is four.

27. The returned stair tread of claim 23 wherein the pins are from approximately one-half of an inch (½") to approximately one inch (1") long and from approximately one thirty-second of an inch (1/32") to approximately three thirty-seconds of an inch (3/32") in diameter.

28. The returned stair tread of claim 27 wherein the pins are countersunk from approximately one sixteenth of an inch (1/16") to approximately one-half of an inch (½") below the surface of said returned stair tread assembly.

29. The returned stair tread of claim 19 wherein said exposed joint comprised a shaped joint, and wherein said tongue and groove construction includes:

a tongue extending along the entire side edge of said stair tread; and, a groove opposing said tongue and extending from the forward end of said nosing along said opposing surface to a position approximately equal to the rearward edge of said stair tread.

30. The returned stair tread of claim 19 wherein the tongue of said construction extends outward from the side edge of said stair tread approximately one-quarter of an inch (¼") to approximately three-quarters of an inch (¾"), and the groove of the nosing of said construction is dimensioned to accommodate a tongue of such dimension.

31. The returned stair tread of claim 19 wherein the tongue of said construction extends inward from the inside edge of said nosing approximately one-quarter inch (¼") to approximately three-quarters of an inch (¾"), and the groove of the stair tread of said construction is dimensioned to accommodate a tongue of such dimension.

32. The returned stair tread of claim 19 wherein the tongue of said returned stair tread is sculptured in the area of said securing means to provide a reservoir for the application of a suitable amount of glue, which reservoir would provide glue to the surfaces of the tongue and groove construction substantially throughout the area of said securing means when said stair tread and nosing are joined.

33. The returned stair tread of claim 19 wherein the tongue of said returned stair tread is sculptured at its rearward end to provide, in concert with said groove, an expansion reservoir therebetween.

34. A method for making a returned tread for use on an open stairway or an open portion of a stairway, the steps of which comprise providing a stair tread constructed of wood, fashioning at least one side edge of said stair tread to fit flush against an opposing surface of a return nosing to form an exposed joint between said stair tread and nosing along a forward end portion of said tread and nosing, providing a return nosing for fitting flush against said side edge, said stair tread and nosing being slidably connectable to each other by tongue and groove construction along a rear portion of said side edge, and securing said nosing to said tread only along a region containing said exposed joint which is located on a forward end portion of said tread forward of said slidably connected construction such that no significant gap or deformation will occur in said exposed joint as the result of expansion or construction of said stair tread over a range of ambient temperature and humidity, and wherein the improvement comprises providing a non-rigid securing means along the length of the mutual juncture of said nosing and said stair tread, which non-rigid securing means is adapted to secure the continued contact of said nosing and stair tread while permitting each to expand and contract in width over a range due to changing ambient temperature and humidity conditions.

35. The method of claim 34 wherein the step of providing said securing means comprises gluing said nosing to said stair tread along said exposed joint.

36. The method of claim 34 wherein the step of providing said non-rigid securing means comprises the insertion of a plurality of pins through said tongue and groove construction of said nosing and stair tread.

* * * * *